US006005595A

United States Patent [19]

Vanwey

[11] Patent Number: 6,005,595

[45] Date of Patent: Dec. 21, 1999

[54] THERMAL PRINTER FOR ELONGATED SUBSTRATES AND METHOD THEREFOR

[75] Inventor: Clifton L. Vanwey, Bolingbrook, Ill.

[73] Assignee: Illinois Tool Works Inc., Glenview, Ill.

[21] Appl. No.: 08/934,721

[22] Filed: Sep. 22, 1997

[51] Int. Cl.[6] ..... B41J 27/12

[52] U.S. Cl. ..... 347/171

[58] Field of Search ..... 347/215, 218, 347/221, 171, 212; 101/44, 41, 36, 37, 35; 156/234; 400/120.01

[56] References Cited

U.S. PATENT DOCUMENTS

| | | | |
|---|---|---|---|
| 4,650,350 | 3/1987 | Dorner | 400/120.01 |
| 4,906,316 | 3/1990 | Seidl | 156/234 |
| 5,184,152 | 2/1993 | French | 347/171 |
| 5,347,617 | 9/1994 | Webb et al. | 395/108 |

FOREIGN PATENT DOCUMENTS

| | | | |
|---|---|---|---|
| 60-232988 | 11/1985 | Japan | 400/232 |
| 61-51357 | 3/1986 | Japan | 347/212 |

*Primary Examiner*—N. Le
*Assistant Examiner*—Anh T. N. Vo

[57] ABSTRACT

A thermal printer system and method for transferring ink from foil onto a plurality of parallel elongated substrates simultaneously, particularly non-flat at least temporarily deformable substrates including heat shrink tubing, by drawing the substrates past the print head and adjacent the foil with a feed roller located downstream the print head, at least temporarily deformably flattening portions of the plurality of substrates by engaging the substrates with a pressure roller located upstream the print head, and transferring ink onto at least temporarily flattened portions of the substrates positioned adjacent the print head to increase productivity. The substrates are stationarily positioned adjacent the print head, which movably sweeps substantially parallel thereto to transfer ink from the foil onto the substrates. The substrates are drawn past the print head at relatively high rates when not printing, and are severable downstream the feed roller, to further increase productivity.

23 Claims, 1 Drawing Sheet

THERMAL PRINTER FOR ELONGATED SUBSTRATES AND METHOD THEREFOR

BACKGROUND OF THE INVENTION

The invention relates generally to product coding and marking, and more particularly to thermal printer systems and methods for printing on elongated substrates, particularly non-flat at least temporarily deformable substrates including heat shrink tubing, among others.

The printing of variable information on elongated substrates including insulated electrical wire and heat shrink tubing in coding and marking operations has been performed in the past by both hot stamp imprinters and thermal printers.

Hot stamp imprinters have the advantage of leaving an impression on the substrate, wherein the ink is recessed below a surface thereof, where it is less susceptible to removal by abrasion. The impression on the substrate is also capable of conveying the imprinted information after the ink is removed, but the impression may have an adverse effect on the structural integrity of the substrate. Hot stamp imprinters have been particularly suitable for imprinting on non-flat, at least temporarily deformable substrates including less costly heat shrink tubing, particularly the smaller diameter tubing, which have diameters of ¼ inch and less.

Thermal printers transfer ink from a print ribbon, or foil, onto the substrate by applying heat to the foil. In the past, information printed with thermal printers had a tendency to wear off over time, but advances in thermal ink compositions have substantially improved the durability thereof for all but the most demanding of applications, particularly some military applications, which have more rigorous specification requirements. Thermal printers are also programmable, which is a significant advantage over other printing systems. Thermal printers are, more particularly, capable of storing and recalling print data relatively easily and less costly than systems having type or dies, which are painstakingly laborious to set and assemble. Thus, there is an increasing tendency to utilize thermal printers in many coding and marking applications, including the marking and coding of elongated substrates.

In one known application, heat shrink tubing manufacturers, including the Raychem and Sumitomo companies, utilize thermal printers to print variable information on relatively expensive pre-flattened heat shrink tubing, particularly larger diameter tubing. According to one known proprietary system, pre-flattened heat shrink tubing is supplied to the thermal printer from a spool having barcode data thereon, which must be read by the thermal printer before printing. The proprietary thermal printer is programmed to permit printing on only tubing supplied from the spool with the barcode data, and moreover will not permit reuse of the spool by winding competitors', very likely less costly, tubing thereabout. Also, the thermal print head of the proprietary thermal printer is stationary relative to the direction the heat shrink tubing is fed, and thus prints as the substrate moves relative thereto. But this mode of operation limits the tubing feed rate since the tubing cannot be fed any faster than the rate at which the print head transfers ink from the foil onto the substrate, which limits productivity.

Thermal printers are generally incapable of printing on non-flattened substrates, like less costly heat shrink tubing, since ink will not transfer from the foil onto the curved surface portions thereof. Thus, in the past, only hot stamp imprinters were used for printing on non-flattened heat shrink tubing, as suggested above. In many thermal printers, including the proprietary thermal printing system discussed above, the substrate has a tendency to rub against the foil as the substrate is fed between the foil and a backup plate, which are spaced relatively closely. As a result, ink from the foil is inadvertently transferred onto the substrate, often leaving ink streaks thereon, which is not pleasing aesthetically and moreover may not comply with some industry and particularly military specifications.

Additionally, known hot stamp imprinters and thermal printers useable for coding and marking elongated substrates are capable of printing on only one substrate at a time, which further limits productivity.

The present invention is drawn toward advancements in the art of product coding and marking, and more particularly to thermal coding and marking systems and methods for printing on elongated substrates.

It is thus an object of the present invention to provide novel thermal coding and marking systems and methods therefor that overcome problems in the prior art, that are economical, and that are useable for printing on elongated substrates, especially generally non-flat at least temporarily deformable elongated substrates including heat shrink tubing, among others.

It is a further object of the invention to provide novel thermal coding and marking systems and methods therefor that increase productivity by feeding one or more elongated substrates in parallel past a thermal print head simultaneously and relatively quickly, that eliminate ink streaking or unintended printing on the substrate caused by rubbing thereof against the foil, and that compensate for misalignment of the print head with a backup plate.

It is a more particular object of the invention to provide novel thermal printer systems and methods for transferring ink from a foil onto elongated substrates, particularly non-flat at least temporarily deformable substrates including heat shrink tubing, by drawing a plurality of parallel elongated substrates past a thermal print head and adjacent the foil with a feed roller located downstream the thermal print head, at least temporarily deformably flattening portions of the plurality of elongated substrates by engaging the substrates with a pressure roller located upstream the thermal print head, and transferring ink onto the at least temporarily flattened portions thereof adjacent the thermal print head.

It is another more particular object of the invention to provide novel thermal printer systems and methods that increase tension on a portion of the plurality of elongated substrates adjacent the thermal print head by increasing drag on the pressure roller with a drag inducing member coupled thereto, and alternatively by feeding the substrate along a relatively circuitous path and over a fixed guide member.

It is another more particular object of the invention to provide novel thermal printer systems and methods that more readily at least temporarily deformably flatten elongated substrates by heating the elongated substrates upstream the thermal print head, and alternatively by feeding the elongated substrates between a resilient roller positioned adjacent the pressure roller.

It is still another more particular object of the invention to provide novel thermal printer systems and methods that stationarily position the plurality of parallel elongated substrates adjacent a print head, then movably sweep the print head substantially parallel to portions of the stationary substrates to transfer ink from the foil onto the substrates, and that subsequently draw the elongated substrates past the thermal print head at relatively high rates when not transferring ink onto the substrates.

It is yet another more particular object of the invention to provide novel thermal printer systems and methods that actuatably position a backup plate away from the foil when not transferring ink onto the elongated substrate to substantially eliminate unintended ink transfer thereon, and that compensate for misalignment of the thermal print head with a floatable resilient pad member disposed on the backup plate opposite the thermal print head.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
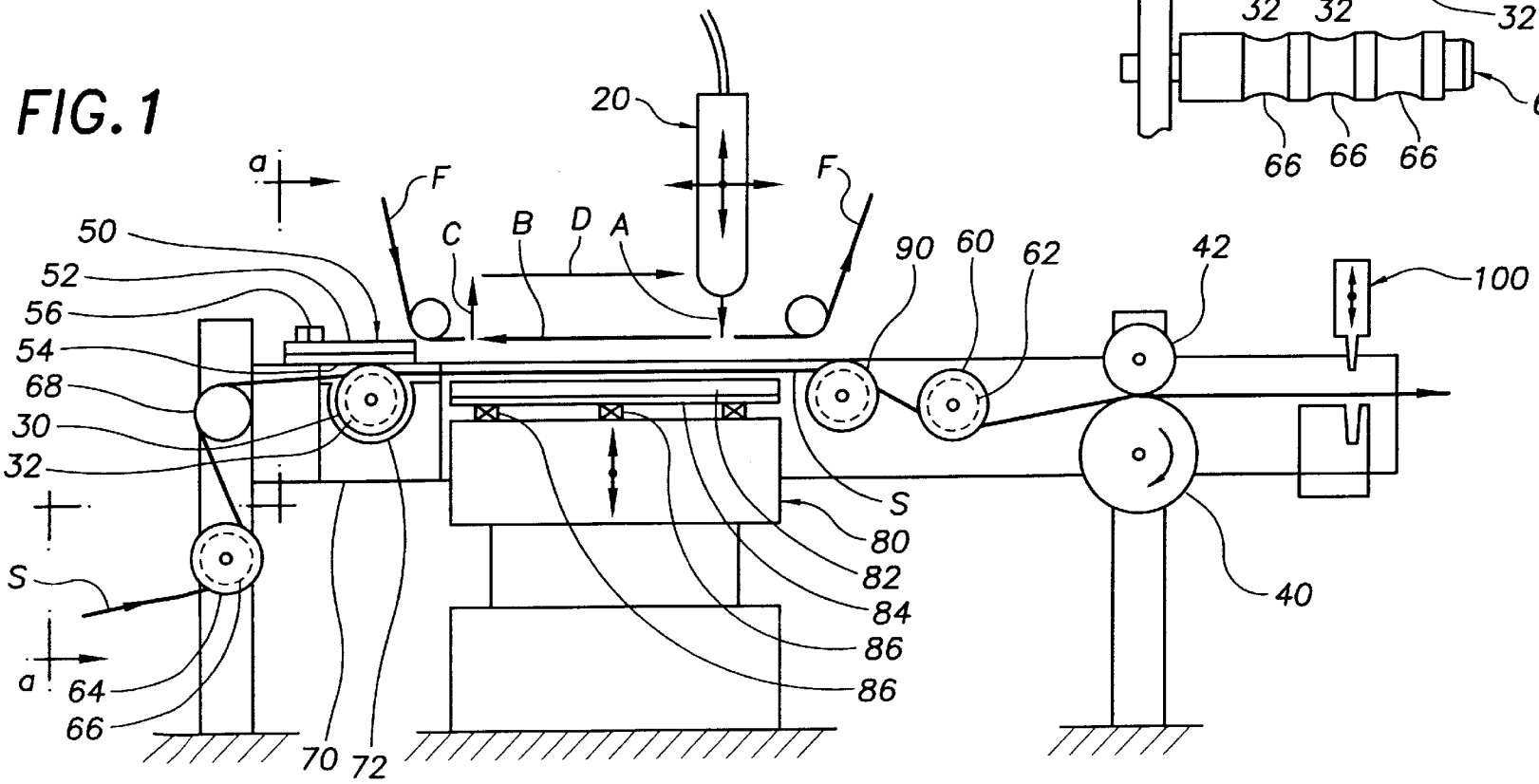
FIG. 1 is a partial side elevational view of a thermal printer system for printing on elongated substrates according to an exemplary embodiment of the invention.

FIG. 1 illustrates a thermal printer system 10 useable for transferring ink from a foil F, shown partially for clarity but known generally, onto elongated substrates, particularly non-flat at least temporarily deformable substrates including heat shrink tubing. The system 10 comprises generally a thermal print head 20 actuatably disposed adjacent the foil F, a pressure roller 30 located upstream the print head 20 and engageable with an elongated substrate S, and a feed roller 40 located downstream the print head 20 for drawing the elongated substrate toward and past the print head 20.

Figure 2:
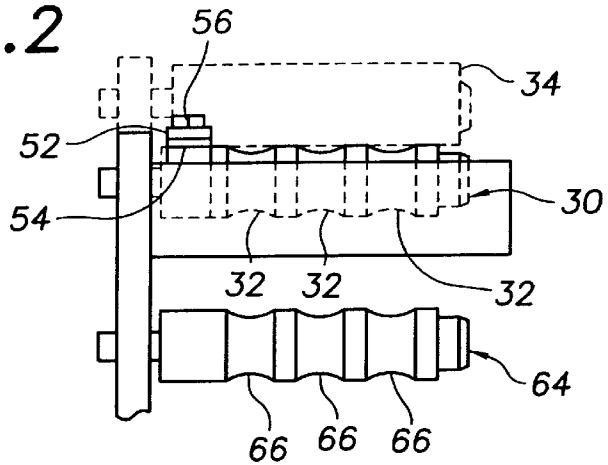
FIG. 2 is a partial upstream end view along lines a—a of the thermal printer system of FIG. 1.

FIGS. 1 and 2 illustrate a drag inducing member 50 engageably coupled to the pressure roller 30 to increase drag thereon, whereby tension on at least a portion of the elongated substrate S adjacent the print head 20 is increased correspondingly. The drag inducing member 50 may comprise, for example, a rigid member 52 with a resilient member 54 fixed to a side thereof facing toward the pressure roller 30, whereby the drag inducing member 50 and particularly the resilient member 54 thereof is adjustably clamped by a bolt 56 or other means into frictional engagement with a portion of the pressure roller 30 to adjustably apply drag thereto, thereby adjustably tensioning the elongated substrate S.

The feed roller 40 located downstream the thermal print head 20 is frictionally engageable with the elongated substrate S to draw the substrate S from a substrate supply, not shown, upstream the print head 20 and engageably past the pressure roller 30 adjacent the foil F. The feed roller 40 is driven rotatably, usually electrically or pneumatically, and cooperates with a resilient idler roller 42 positioned, and in one embodiment biased, toward the feed roller 40 to frictionally engage the elongated substrate S. The feed roller 40 may also have a knurled surface, not shown, to facilitate frictional engagement with the elongated substrate S. The feed roller 40 may more generally be any other member suitable for drawing the elongated substrate S past the print head 20, for example, a rotatably driven spool useable for rewinding the elongated substrate.

As the substrate is drawn engageably past the pressure roller 30, a portion of the elongated substrate S is at least temporarily deformably flattenable thereby as the portion of the elongated substrate S is drawn toward the print head 20, whereby ink is transferrable from the foil F by the thermal print head 20 onto the at least temporarily flattened portion of the elongated substrate S.

Generally, a first guide member is located upstream the print head 20, and a second guide member is located downstream the print head 20 to guide the elongated substrate S along a path fixed relative to the print head 20. Preferably, the first and second guide members are each configured to guide a plurality of at least two and as many as three or more elongated substrates S along corresponding parallel paths fixed relative to the print head 20. The portions of the plurality of elongated substrates S are at least temporarily deformably flattenable by the pressure roller 30 as the substrates are drawn toward the thermal print head 20, whereby ink is transferrable from the foil F by the print head 20 onto the at least temporarily flattened portions of the plurality of elongated substrates S. The thermal printer system 10 is thus capable of printing on several elongated substrates S simultaneously, which increases production remarkably. The elongated substrate S illustrated in FIG. 1 and referenced herein in connection with the present invention is thus representative generally of a plurality of parallel elongated substrates.

In FIGS. 1 and 2, the first guide member is a first plurality of grooves 32 formed about the pressure roller 30, and the second guide member is a second plurality of grooves 62 formed about a first guide roller 60 located downstream the print head 20. The first and second plurality of grooves correspond at least to the plurality of the elongated substrates S, whereby each of the plurality of elongated substrates is guided by a corresponding groove on each roller. The first and second guide members thus align the plurality of elongated substrates S relative to the print head to ensure proper transfer of ink from the foil F, and more particularly to ensure accurate location of ink transfer onto the substrates. In alternative embodiments, the grooves may be formed on other guide rollers, not shown, or the first and second guide members may be fixed members with corresponding channels or slots formed therein, not shown, but located generally upstream and downstream the print head 20.

FIG. 1 also illustrates a second guide roller 64, which may or may not have grooves 66 therein for guiding the elongated substrate S, and a fixed guide member 68 both located upstream of the print head 20, and more particularly upstream the pressure roller 30. According to this aspect of the invention, the elongated substrate S is supplied along a relatively circuitous path from the second guide roller 64 to the fixed guide member 68 and then to the pressure roller 30, whereby the circuitous path, especially in combination with the fixed guide member 68, has a tendency to increase drag on the elongated substrate S and thus increase tension thereon, which facilitates at least temporarily deformably flattening ordinarily non-flat elongated substrates like heat shrink tubing.

FIGS. 1 and 2 illustrate generally a heater 70 located upstream the print head 20 for heating the elongated substrate S, whereby the heated elongated substrate is more readily at least temporarily deformably flattenable by the pressure roller 30. In the exemplary embodiment, the heater 70 is located proximate the pressure roller 30, and comprises more particularly a heater block with a recess 72 for accommodating a lower portion of the pressure roller 30, whereby the heater block is disposed partially about the pressure roller 30 on an under side thereof, to radiantly heat the pressure roller 30, which subsequently transfers heat to the elongated substrate S in engagement therewith. The heater 70 is particularly useful for at least temporarily deformably flattening relatively rigid elongated substrates S. FIG. 2 shows another related alternative embodiment, including a second resilient roller 34 positioned, and in one embodiment biased, toward the pressure roller 30 to facilitate flattening the elongated substrate S, particularly relatively rigid substrates. The resilient roller 34 may be used alone or in combination with the heater 70, and has the advantage of being a passive device, which does not require an external power supply.

According to one mode of operating the system 10, the elongated substrate S is positionable stationarily adjacent the thermal print head 20 by intermittently advancing or drawing the substrate S with the feed roller 40. FIG. 1 illustrates the thermal print head 20 being movably sweepable substantially parallel to a portion of the stationary elongated substrate S to transfer ink from the foil F onto the elongated substrate S. In the exemplary embodiment, the print head 20 is generally movable in two dimensions along paths A-B-C-D. Printing occurs as the print head is swept along path B, wherein path D is a return path and paths A and B position the print head toward and away from the foil, respectively. One thermal printer suitable for this application and mode of operation is the Compular Model 2800 Programmable Thermal printer available from ITW Compular.

After printing, the elongated substrate S is drawable past the print head 20 at a relatively high rate of speed without regard for the rate at which the print head 20 transfers ink from the foil F, since the substrate is advanced or drawn only when not transferring ink onto the elongated substrate S. The thermal print head may alternatively be programmed to print back and forth. Also, alternatively, stationary thermal printers may be used as in the known prior art, but productivity is limited since the substrate feed rate is limited to the rate at which the stationary print head transfers ink onto the substrate as discussed hereinabove.

FIG. 1 illustrates a backup plate 80 disposed adjacent the thermal print head 20 opposite the foil F, whereby the elongated substrate S is drawn between the foil F and the backup plate 80. In one preferred embodiment, the backup plate 80 is actuatably positionable away from the foil F when not transferring ink onto the elongated substrate S to substantially eliminate the tendency for the elongated substrate S to rub against the foil F as it is drawn past the print head 20, thereby substantially eliminating undesirable ink streaking. The positioning of the backup plate 80 away from the foil F when not printing is particularly important in thermal printer systems since the backup plate is positioned relatively close thereto during printing, which increases the tendency for rubbing and thus unintended ink transfer onto the substrate. In one embodiment, the backup plate 80 is actuatable toward and away from the foil F pneumatically.

In another embodiment, the backup plate 80 includes a resilient pad member 82 disposed toward the thermal print head 20. The resilient pad member 82, which may be mounted on a rigid member 84, is coupled to the backup plate 80 by a plurality of spring members 86, whereby the resilient pad member 82 is floatable relative to the backup plate 80 to compensate for misalignment of the thermal print head 20. The floating resilient pad member 82 supports the substrate S and the foil F as the thermal print head is swept past the foil, thereby ensuring complete ink transfer onto the substrate. In a related alternative embodiment, a third guide roller 90 is located downstream the backup plate 80 to support the elongated substrate S adjacent the backup plate, thereby preventing wear on the resilient pad member 82, particularly the downstream edge portion thereof, caused by friction from the elongated substrate S, which tends to occur absent the third guide roller 90.

FIG. 1 illustrates a cutter 100 located downstream the feed roller 40, whereby the elongated substrate S is severable after printing. The cutter width is preferably sufficient to cut a plurality of parallel elongated substrates S printed by the system 10, thereby substantially increasing productivity. One such cutter suitable for this application is on a Kingsley printer Model No. MCM-1000, available from ITW Kingsley, Downers Grove, Ill.

While the foregoing written description of the invention enables one of ordinary skill in the art to make and use what is at present considered to be the best mode of the invention, it will be appreciated and understood by those of ordinary skill the existence of variations, combinations, modifications and equivalents within the spirit and scope of the specific exemplary embodiments disclosed herein. The present invention is therefore to be limited not by the specific exemplary embodiments disclosed herein but by all embodiments within the scope of the appended claims.

What is claimed is:

1. A thermal printer system for transferring ink from a foil onto non-flat at least temporarily deformable elongated substrates including heat shrink tubing, the system comprising:

a thermal print head;

a non-flat at least temporarily deformable elongated substrate adjacent the print head;

a pressure roller located upstream the thermal print head, the pressure roller frictionally engaged with the elongated substrate;

a drag inducing member fictionally engaged the pressure roller;

a feed roller located downstream the thermal print head, the feed roller frictionally engaged with the elongated substrate to draw the elongated substrate from upstream the thermal print head about the pressure roller, and then past the thermal print head, the elongated substrate at least temporarily flattened as it is drawn about the pressure roller, a flattened portion of the elongated substrate positioned under the thermal print head.

2. The system of claim 1, a first upstream guide roller located upstream the thermal print heads the first upstream guide roller having a plurality of at least two grooves formed thereabout;

a downstream guide roller located downstream the thermal print head, the downstream guide roller having a plurality of at least two grooves formed thereabout, a plurality of non-flat at least temporarily deformable elongated substrates aligned along parallel paths adjacent the thermal print head, the plurality of elongated substrates disposed in a corresponding one of the plurality of grooves of the first upstream guide roller and in a corresponding one of the plurality of grooves of the downstream guide roller, the feed roller frictionally engaged with the plurality of elongated substrates to draw the plurality of elongated substrates from upstream the thermal print head about the pressure roller, and then past the thermal print head, the plurality of elongated substrates at least temporarily flattened as they are drawn about the pressure roller, flattened portions of the plurality of elongated substrates positioned under the thermal print head.

3. The system of claim 2, the first upstream guide roller is the pressure roller, a second upstream guide roller located upstream the first upstream guide roller, the plurality of elongated substrates disposed partially about the second upstream guide roller.

4. The system of claim 1, a heater located upstream the thermal print head proximate the elongated substrate.

5. The system of claim 4, the heater disposed partially about the pressure roller to heat the pressure roller, whereby the pressure roller transfers heat to the elongated substrate.

6. The system of claim 1, the thermal print head is a reciprocative print head movable back and forth in first and second opposing directions generally parallel to the flattened portion of the elongated substrate.

7. The system of claim 1, a second upstream guide roller located upstream the first upstream guide roller, and a fixed guide member located between the first upstream guide roller and the second upstream guide roller, the elongated substrate is supplied from the second upstream guide roller partially about the fixed guide member and then to the pressure roller.

8. The system of claim 1, a cutter downstream the feed roller.

9. The system of claim 1, a backup plate disposed opposite the thermal print head.

10. The system of claim 9, the backup plate is a movable backup plate positioned toward the elongated substrate when transferring ink onto the elongated substrate, the backup plate is positioned away from the elongated substrate when not transferring ink onto the elongated substrate.

11. The system of claim 9, the backup plate having a resilient pad member disposed facing toward the thermal print head, the resilient pad member coupled to the backup plate by spring members, the resilient pad member floats relative to the backup plate.

12. The system of claim 9 further comprising a third guide roller downstream the backup plate, the third guide roller supporting the elongated substrate adjacent the backup plate.

13. A thermal printer system for transferring ink from foil onto substrates, the system comprising:

a thermal print head;

a backup plate positioned adjacent the thermal print head, a substrate disposed between the backup plate and the thermal print head, the backup plate having a resilient pad member disposed facing toward the thermal print head, the resilient pad member coupled to the backup plate by spring members, whereby the resilient pad member floats relative to the backup plate.

14. The system of claim 13, the thermal print head is a reciprocative print head movable back and forth in first and second opposing directions generally parallel to a portion of the substrate.

15. A method of transferring ink from a foil with a thermal print head onto non-flat at least temporarily deformable elongated substrates including heat shrink tubing, the method comprising:

drawing a non-flat at least temporarily deformable elongated substrate past the thermal print head and adjacent the foil with a feed roller located on a downstream side of the thermal print head;

at least temporarily flattening a portion of the elongated substrate by engaging the elongated substrate with a pressure roller having a drag inducing member frictionally engaged therewith located upstream the thermal print head as the elongated substrate is drawn toward the thermal print head;

transferring ink onto the flattened portion of the elongated substrate with the thermal print head.

16. The method of claim 15, drawing a plurality of non-flat at least temporarily deformable elongated substrates along parallel paths past the thermal print head and adjacent the foil with the feed roller;

guiding the plurality of elongated substrates with a first upstream guide roller upstream the thermal print head and a downstream guide roller downstream the thermal print head;

at least temporarily flattening portions of the plurality of elongated substrates by engaging the plurality of elongated substrates with the pressure roller as the plurality of elongated substrates are drawn toward the thermal print head;

transferring ink onto the flattened portions of the plurality of elongated substrates with the thermal print head.

17. The method of claim 15, heating the elongated substrate with a heater located upstream the thermal print head proximate the elongated substrate.

18. The method of claim 15, stationarily positioning the elongated substrate adjacent the thermal print head, sweeping the thermal print head generally parallel to a flattened portion of the elongated substrate to transfer ink from the foil onto the elongated substrate, and drawing the elongated substrate past the thermal print head when not transferring ink onto the elongated substrate.

19. The method of claim 15, severing the elongated substrate with a cutter located downstream the feed roller.

20. The method of claim 15, supporting the substrate with a backup plate positioned adjacent the elongated substrate when transferring ink onto the elongated substrate, positioning the backup plate away from the elongated substrate when not transferring ink onto the elongated substrate.

21. The method of claim 20, compensating for misalignment of the thermal print head with a floating resilient pad member disposed on the backup plate opposite the thermal print head.

22. A method for transferring ink from foil onto substrates with a thermal print head, the method comprising:

positioning a substrate adjacent the foil;

transferring ink from the foil onto the substrate with the thermal print head;

supporting the substrate with a backup plate positioned adjacent the substrate and opposite the thermal print head when transferring ink onto the substrate;

compensating for misalignment of the thermal print head with a floating resilient pad member disposed on the backup plate;

positioning the backup plate away from the substrate when not transferring ink onto the substrate.

23. The method of claim 22, stationarily positioning the substrate adjacent the thermal print head, sweeping the thermal print head generally parallel to a portion of the substrate to transfer ink from the foil onto the substrate, and drawing the substrate past the thermal print head when not transferring ink onto the substrate.

* * * * *